United States Patent [19]

Watts et al.

[11] Patent Number: 4,754,820

[45] Date of Patent: Jul. 5, 1988

[54] DRILLING HEAD WITH BAYONET COUPLING

[75] Inventors: James T. Watts, Fullerton; Eric G. Dodd, Paramount, both of Calif.

[73] Assignee: Drilex Systems, Inc., Houston, Tex.

[21] Appl. No.: 875,886

[22] Filed: Jun. 18, 1986

[51] Int. Cl.[4] ..... E21B 3/04

[52] U.S. Cl. ..... 175/195; 285/362; 285/912

[58] Field of Search ..... 175/195, 209, 210, 214; 166/78, 84; 277/31; 285/912, 360, 362, 376, 377, 401; 173/165

[56] References Cited

U.S. PATENT DOCUMENTS

| | | | |
|---|---|---|---|
| 1,097,508 | 5/1914 | Bailey | 285/362 |
| 2,163,813 | 6/1939 | Stone et al. . | |
| 2,170,916 | 8/1939 | Schweitzer et al. . | |
| 2,327,980 | 8/1943 | Bryant | 74/625 |
| 2,995,196 | 8/1961 | Gibson et al. | 175/7 |
| 3,023,012 | 2/1962 | Wilde | 277/31 |
| 3,128,614 | 4/1964 | Auer . | |
| 3,285,352 | 11/1966 | Hunter | 175/214 |
| 3,400,938 | 9/1968 | Williams | 175/214 |
| 3,661,409 | 5/1972 | Brown et al. | 285/82 |
| 3,934,887 | 1/1976 | Biffle | 277/31 |
| 4,285,406 | 8/1981 | Garrett et al. | 175/195 |
| 4,293,047 | 10/1981 | Young | 175/195 |
| 4,304,310 | 12/1981 | Garrett | 175/195 |
| 4,312,404 | 1/1982 | Morrow | 166/84 |
| 4,363,357 | 12/1982 | Hunter | 166/84 |
| 4,398,599 | 8/1983 | Murray | 166/95 |
| 4,416,340 | 11/1983 | Bailey | 175/195 |
| 4,461,354 | 7/1984 | Buras et al. | 285/912 X |
| 4,480,703 | 11/1984 | Garrett | 175/195 |

FOREIGN PATENT DOCUMENTS

| | | | |
|---|---|---|---|
| 1164943 | 10/1958 | France | 285/360 |

OTHER PUBLICATIONS

Grant Oil Tool Company, Bulletin 86, entitled "Grant Rotating Drilling Heads".

*Primary Examiner*—James A. Leppink
*Assistant Examiner*—Hoang C. Dang
*Attorney, Agent, or Firm*—Leon E. Redman; Malcolm L. Sutherland

[57] ABSTRACT

A drilling head with an upper body assembly removably clamped onto a stationary spool via a bayonet-type coupler clamp rotated into clamped and unclamped positions by a remote controlled hydraulic motor connected to the clamp by a ring and pinion gear. The upper body assembly has a kelly bushing, a corrugated drive bushing rotatable with the kelly bushing, a drive ring rotatable with the drive bushing a bearing assembly surrounding the drive ring, and an elastomeric stripper connected to the drive ring for rotation therewith. The stripper is adapted for sealing engagement with a rotating kelly drive which slides down through the drilling head. Quick connect/disconnect lubrication fittings on the clamp and upper body assembly are releasably mated upon rotation of the clamp to the clamped position to provide lubrication from a single lubrication line to both the bearing assembly and seals via passageways formed in the outer body of the upper body assembly.

30 Claims, 5 Drawing Sheets

DRILLING HEAD WITH BAYONET COUPLING

BACKGROUND

This invention relates to well drilling apparatus and more particularly to an improved rotating drilling head. The drilling apparatus generally comprises a rotatable drill stem used to rotate a drill bit within the well. The drill stem may include a string of drill pipes connected with a non-circular cross-section pipe, commonly referred to as a kelly, slidably extending downwardly through the rotary table. The kelly, being a part of the drill stem, transmits the drive from the rotary table to the drilling head via the kelly bushings. In the usual forward circulation drilling operation, a drilling fluid such as a liquid or compressed air or gas may be forced through the interior of the hollow drill stem and drill bit at the bottom of the well bore. Cuttings and debris at the bottom of the well are entrained in the drilling fluid and carried upwardly in the annulus between the outside of the drill stem and the inside surface of the well bore or casing. In a reverse circulation drilling operation, the drilling fluid is pumped down the annulus between the well bore or casing and forced upward through the drill bit and interior of the hollow drill stem.

The rotating drilling head is attached to the top of a well stack which may have a conventional blowout preventer at its upper end.

The drilling head includes a stationary outer housing or tubular spool which is secured to the top of the stack, a drive ring and bearing assembly, and a drive assembly which is matable with the drive ring and bearing assembly. The drive assembly includes a split kelly bushing. A rubber stripper is attached for rotation with the drive ring in slidable sealing engagement with the kelly drive.

In operation, the split kelly bushing is slidably connected to the kelly drive. As the kelly drive is lowered through the drilling head the kelly bushing is received within the drive assembly. Rotation of the kelly causes the kelly bushing to rotate which rotates the drive assembly, which in turn rotates the drive ring and attached rubber stripper. Thus, in operation, there is no relative rotational movement between the rubber stripper and the kelly drive.

Various arrangements have been provided for removing worn drilling head components from the spool. In certain arrangements, an expandable/contractible split clamp is employed to removably secure such drilling head components to the spool. Such clamps incorporate a plurality of pivoting segments which together may be moved radially outward or inward by a remote controlled hydraulic motor driven screw. Such remote control eliminates the need for a workman to go under the rig floor and manually operate the clamp. Problems have been experienced with such split clamps. For example, mud and debris tend to accumulate about the clamp segments which obstructs proper radial movement. Also, it is necessary to connect/disconnect a lubrication line directly to the spool at a location relatively remote from the bearing assembly.

An object of the invention is to facilitate the assembly, installation, operation and maintenance of a drilling head in which components subject to wear may be readily removed for replacement and reinstalled.

Another object of the invention is to releasably secure removable components to the drilling head spool with a reliable clamp which operates properly in the presence of mud and debris which tends to obstruct the remote controlled operation of multi-segmented clamps.

Still another object of the present invention is to facilitate lubrication of the rotating components, seals and the bearing assembly of the drilling head.

The above objects and many other objects, features and advantages of the present invention will become apparent to those skilled in the art when the detailed description of the preferred embodiment is read in conjunction with the drawings.

SUMMARY

The present invention provides a rotating drilling head with an upper body assembly which houses a kelly bushing, drive and bearing assembly, along with a stripper. The upper body assembly is secured to a tubular spool by a rotatable clamp via a bayonet-type coupler arrangement. The clamp is selectively rotated between clamped and unclamped positions by a remote controlled hydraulic motor. Quick connect/disconnect lubrication couplings provided on the outside of the upper body assembly and the clamp are releasably mated upon rotation of the clamp to the clamped position to provide lubrication from a single source to the rotating components, seals and the bearing assembly contained in the upper body assembly via passageways formed in the outer body.

The kelly bushing is split into two complementary parts configured and interfitted to be fastened together by bolts accessible from above the top of the kelly bushing.

BRIEF DESCRIPTION OF THE DRAWINGS

FIG. 7 is a section taken along plane 7—7 of FIG. 2 showing the upper body assembly in the unclamped position.

DESCRIPTION OF THE PREFERRED EMBODIMENT

Figure 1:
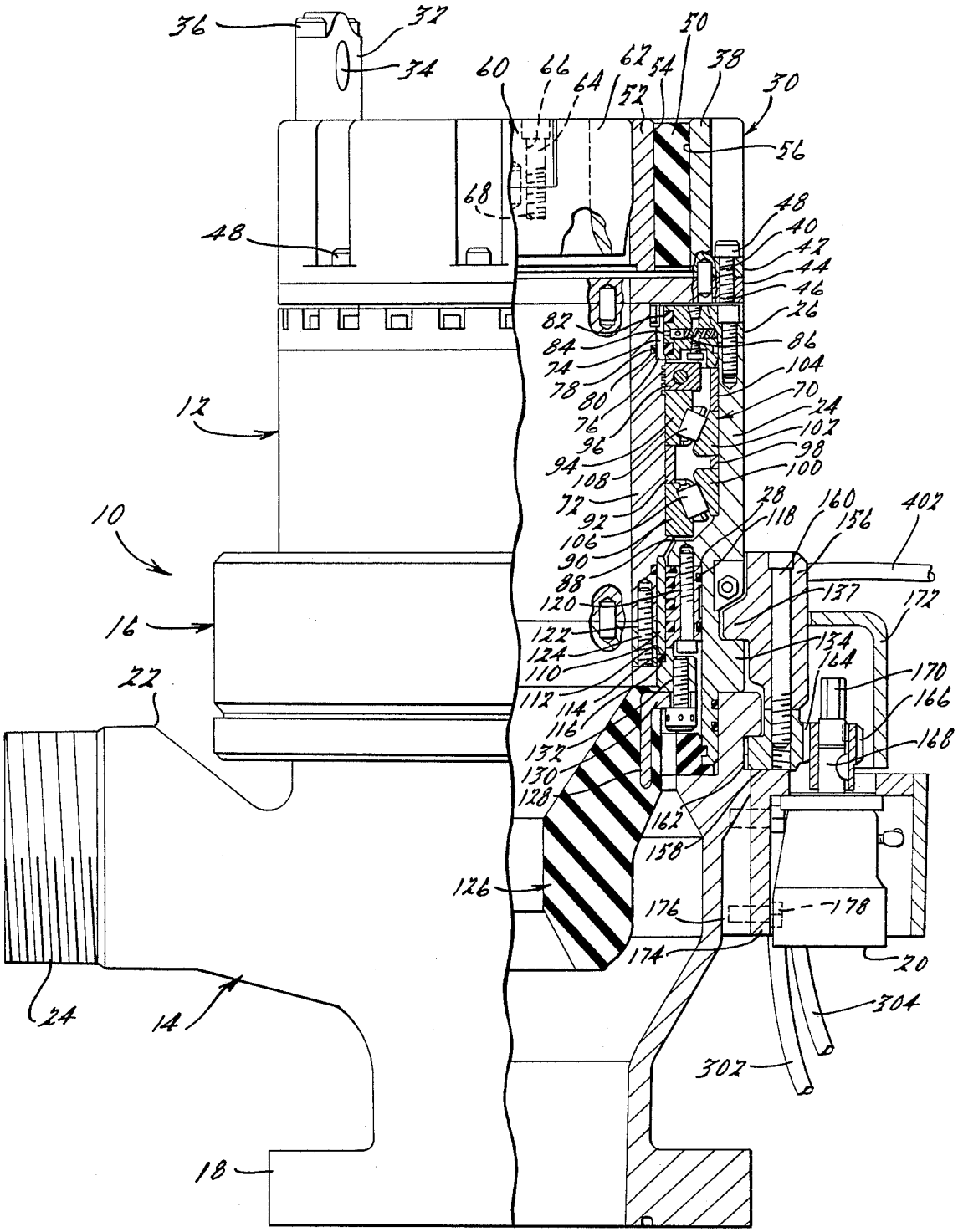
FIG. 1 is an elevation, partly in section, showing the drilling head of the present invention.

Referring now to the drawing, the drilling head of the present invention is generally indicated by the reference numeral 10 and includes an upper body assembly 12, a spool 14 and a clamp 16. The upper body assembly 12 is releasably secured to the spool 14 in a bayonet fashion upon rotation of the clamp 16 in response to the remote control actuation of a hydraulic motor 20. In operation, the drilling head 10 is disposed below a rotary table (not shown) of conventional construction on the upper side of a derrick floor (not shown). The rotary table includes a rotatable, hollow, noncircular shaped kelly which extends through a bushing in the rotary table, downward into the drilling head 10 through a kelly bushing 58 past an elastomeric stripper 126 and out the bottom opening of the drilling head. A power transmitting mechanism rotates the kelly extending through the rotary table. A drilling string attached to the kelly is rotated therewith. The drilling string may include a series of vertically stacked hollow drill stems or pipes connected one to the other with the kelly connected to the uppermost drill stem.

An inlet flange 18 is provided at the base of the spool 14 for securing the drilling head 10 to a mating flange at the upper end of a well casing or the top flange of a blow out preventer. An outlet nipple 22 is formed on one side of the casing of the drilling head 10 to enable the discharge of fluid from the side opening of the drilling head 10. The outlet nipple 22 is provided with external threads 24 for securing a suitable fluid conduit to the housing of the drilling head 10 in order to conduct fluid therefrom.

The upper body assembly 12 includes an outer body 24 which supports a top plate seal holder assembly 26, a lower end seal holder assembly 28, and a drive bushing assembly 30. Lifting brackets 32, each having an eyelet 34, is secured to the outer housing 38 of the drive bushing assembly 30 via bolts 36 to facilitate lowering the entire upper body assembly 12 through the clamp 16 onto the spool 14 and also for lifting the entire upper body assembly 12 from the drilling head 10 when the clamp 16 is rotated to the unclamped position as described later.

Figure 6:
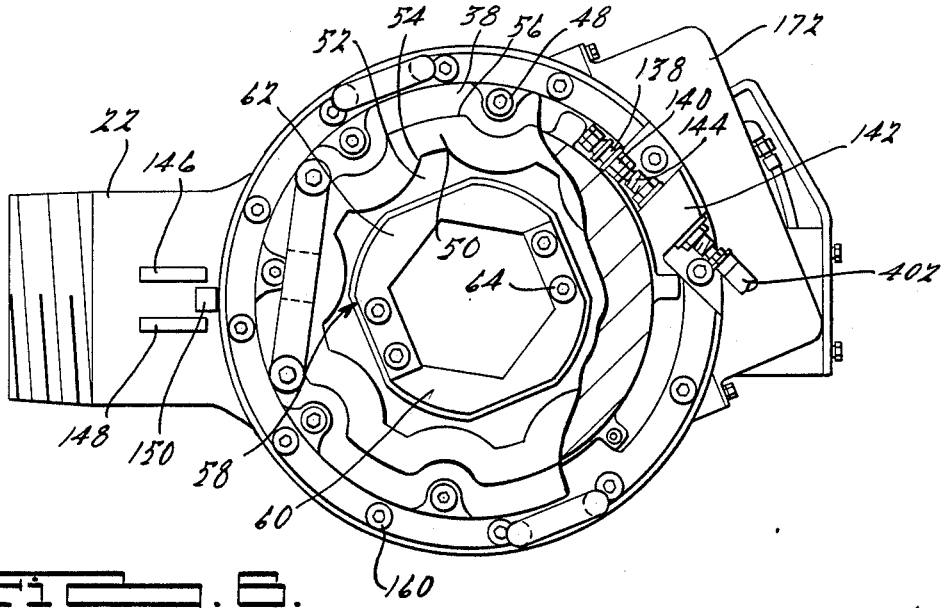
FIG. 6 is a fragmentary section taken along the plane 6—6 of FIG. 2 with the upper body assembly in a clamped position and partially fragmented to show the mating of the lubrication couplings in the clamped position.
Figure 2:
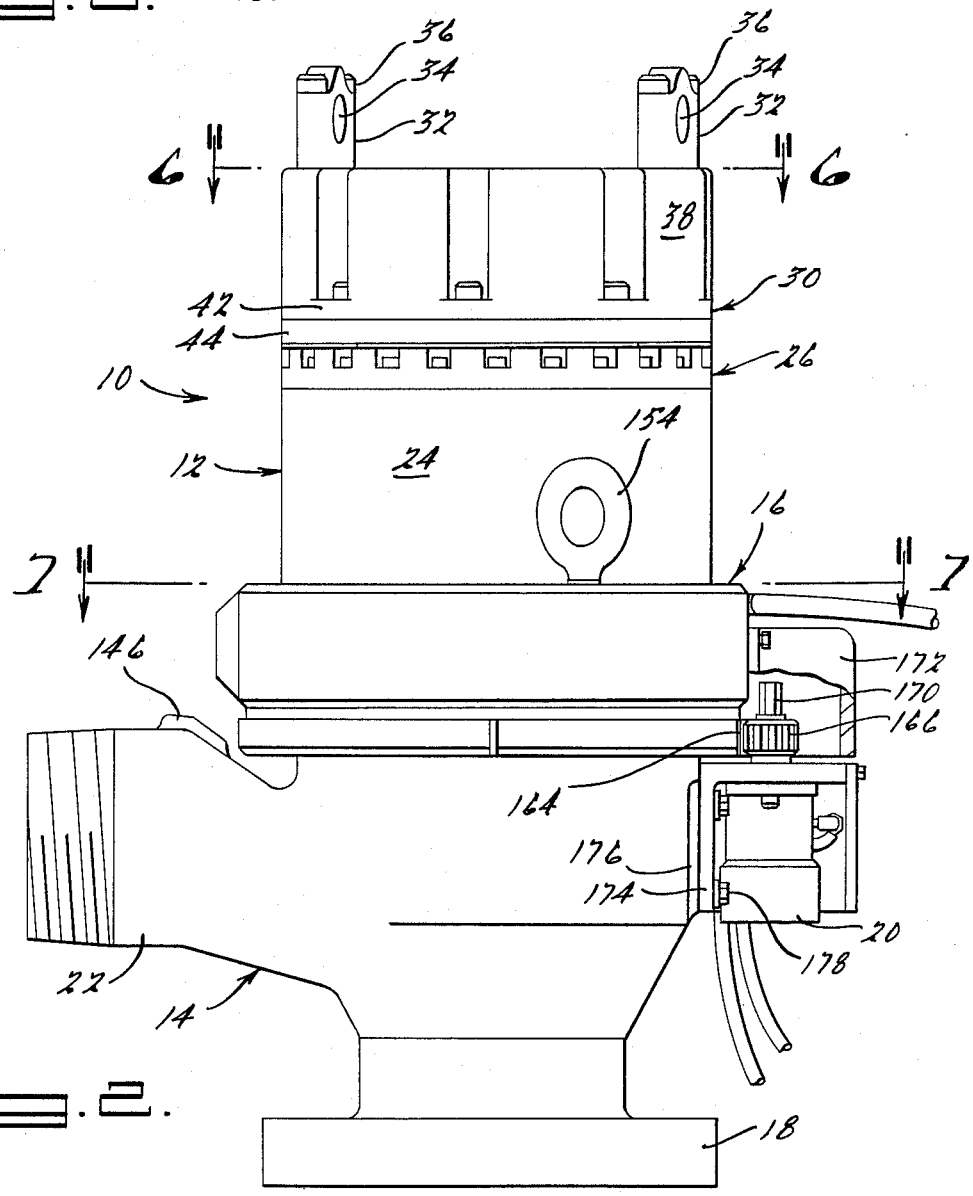
FIG. 2 is a side elevation view of the drilling head of the present invention partially broken away to show the hydraulic motor and pinion gear.
Figure 2:
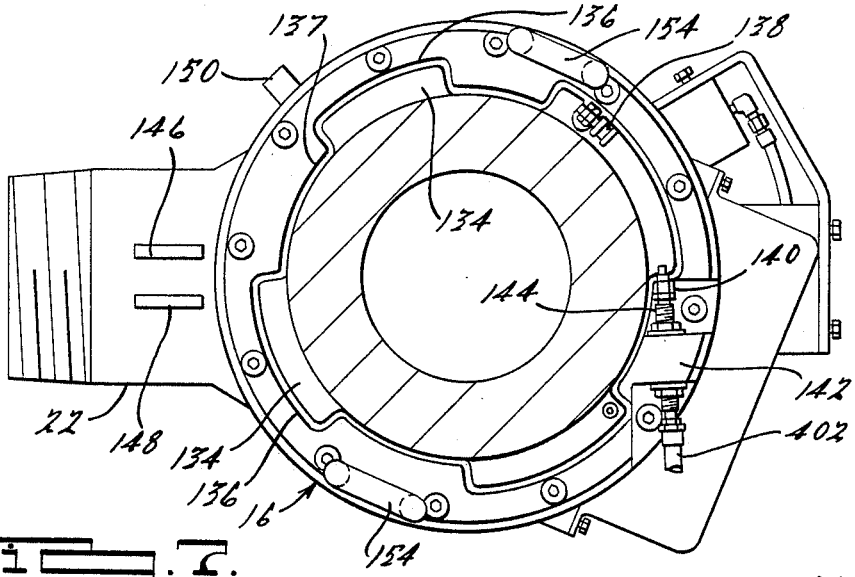
Figure 3:
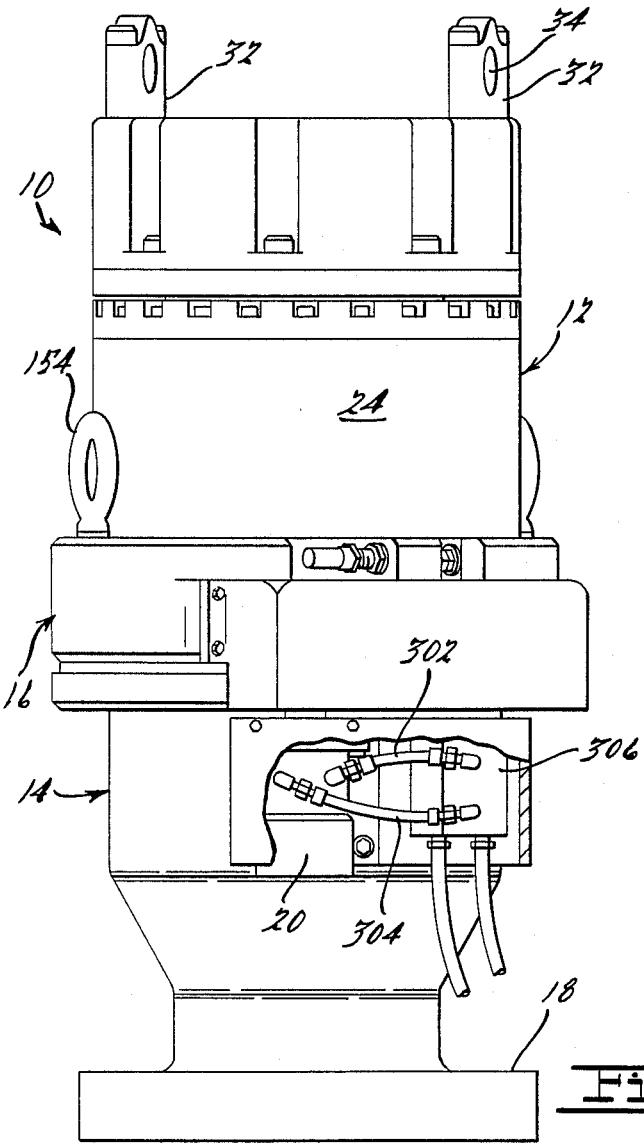
FIG. 3 is a rear elevation partially fragmented to show the hydraulic lock manifold and hydraulic hoses.
Figure 4:
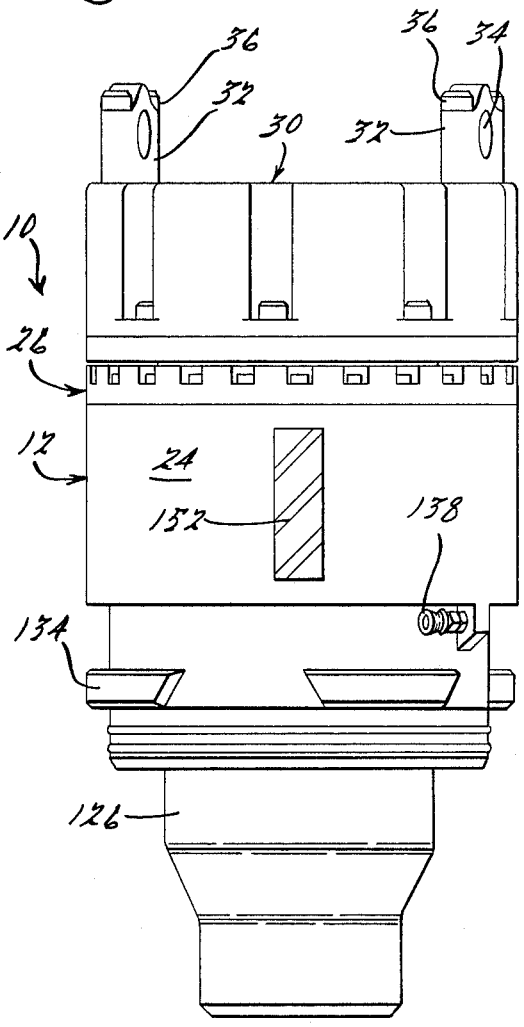
FIG. 4 is an elevation of the upper body assembly removed from the drilling head of FIG. 3.

The outer housing 38 is provided with a plurality of circumferentially spaced holes 40 through the outer housing base 42. A circular drive bushing adapter plate 44 is provided with a plurality of circumferentially spaced holes 46 vertically aligned with the holes 40. The outer housing 38 is secured to the drive bushing adapter plate 44 by a plurality of circumferentially spaced bolts 48 extending downwardly through the aligned holes 40 and 46. An elastomeric intermediate shock absorber 50 is sandwiched between the outer drive bushing housing 38 and an inner drive bushing member 52. The outer surface 54 of the inner drive bushing member 52 is mated with and bonded to the shock absorber 50. The shock absorber 50 functions to isolate shock and vibration between the inner drive bushing member 52 and the outer drive bushing housing 38 (FIG. 6). The shock absorber 50 is generally corrugated in cross-sectional shape. The configuration of the inner surface 56 of the outer housing 38 is complementary in configuration to the generally corrugated cross-sectional shape of the shock absorber 50. This design results in rotational drive being transmitted to the drive bushing housing 38 from the kelly bushing 58 even if the shock absorber or cushion 50 should deteriorate to a degree or if the bond between the shock absorber 50 and the outer surface 54 of the inner drive bushing member 52 fails.

As can be seen in FIGS. 1 and 6, the kelly bushing 58 is split in two complementary kelly bushing members 60 and 62 interfitted together. A lower side portion of member 60 is interfitted underneath an upper side portion of member 62 on one side of the kelly bushing 58. On the opposite side of the kelly bushing 58 an upper portion of member 60 is disposed directly above and interfitted with a complementary lower portion of member 62. Members 60 and 62 thus may be bolted together from the top via bolts 64 through the counterbored bolt holes 66 which are aligned with the underlying threaded holes 68.

The upper body assembly 12 includes a bearing assembly 70 sandwiched between the outer body 24 of the drilling head 10 and a rotatable drive ring 72 (FIG. 1). The bearing assembly 70 is sealed at its upper end by the top plate seal holder assembly 26 and at its lower end by the lower end seal holder assembly 28. An upper wear ring 74 is provided within an annular recess 76 at the top of the drive ring 72. An O-ring 78 is disposed in an annular groove 80 approximate the lower end of the upper wear ring 74. Lip seals 82 are provided in annular grooves formed on the inner surface of the top plate seal holder assembly 26. A passageway 84 communicates lubrication to the upper wear ring 74 between the lip seals 82. A check valve 86 closes the outer end of the passageway 84 and insures that lubrication flows only in the direction of the annular space between the upper wear ring 74 and the top plate seal holder assembly 26.

The drive ring 72 is provided with an external annular shoulder 88 which supports a lower inner bearing race 90. A spacer ring 92 is provided around the drive ring 72 between the bearing race 90 and an upper inner bearing race 94 which is held in place by a lock ring 96 threadably secured to the drive ring 72. A spacer ring 98 separates the outer races 100 and 102. A spacer ring 104 separates the upper outer race 102 from the top plate seal holder assembly 26. The bearing assembly 70 further includes a plurality of tapered roller bearings 106 positioned between lower inner race 90 and outer race 100. A plurality of tapered roller bearings 108 are positioned between upper inner race 94 and outer race 102. The bearing assembly 70 thus limits both horizontal and vertical movement of the drive ring 72 which is rotatable with respect to the outer body 24 of the drilling head 10.

A lower wear ring 110 is positioned within an annular recess 112 provided about the outer surface at the lower end of the drive ring 72. The lower end seal holder assembly 28 is provided with three inner lip seals 114 which are in rotatable contact with the lower wear ring 110. The lip seals 114 are disposed in annular grooves 116 formed in the inner surface of the lower end seal holder 28. A pair of O-rings 118 provide a seal at the upper and lower outer surface of the seal holder 28 and the inner surface of the body 24. The lower end seal holder assembly is secured to the body 24 via a plurality of circumferentially spaced bolts 120.

A stripper adapter plate 122 is secured to the underside of the drive ring 72 via a plurality of circumferentially spaced bolts 124. Secured to and extending downwardly from the stripper adapter plate is a stripper or wiper member generally designated 126 formed of elastomeric material and adapted to engage a kelly or drill stem in fluid sealing contact. A stiffener member 128 is bonded within the upper portion of the wiper 126. The stiffener member 128 is generally cylindrical and includes an outwardly extending horizontal flange 130 through which the stripper may be secured to the underside of the stripper adapter plate 122 via a plurality of circumferentially spaced bolts 132.

Referring now to FIGS. 1 through 7, the bayonet coupling arrangement of the present drilling head invention will now be described. A plurality of circumferentially spaced apart segments 134 are integral with and extend radially outwardly from the lower portion of the outer body 24. A plurality of segment receiving openings 136 are formed on the inner surface of the rotatable clamp 16. The segment receiving openings 136 are complementary in size and configuration to corresponding segments 134. Corresponding pairs of segments 134 and openings 136 differ from other corresponding pairs in size and configuration to ensure that the upper body assembly 12 is received in the rotatable clamp 16 only in proper orientation. This facilitates connection of lubrication coupling 138, which is mounted on the outer body 24 with the lubrication coupling 140 provided on the rotatable clamp 16 upon rotating the clamp 16 into the clamped position (FIG. 6). It is important that the couplings 138 and 140 properly mate with each other upon rotation of the clamp 16 to the clamped position so that lubricating oil can be provided to the lower wear ring 110, the bearing assembly 70, and the upper wear ring 74, as will be described later. The clamp lubrication coupling 140 is a male coupling member adjustably mounted on a boss 142 via a threaded adjusting rod 144 (FIGS. 6 and 7). A cushion ring may be provided around the adjusting rod 144 in order to compensate for minor misalignment and absorb any shock when the male coupling member 140 is mated with the female coupling member 138 upon rotation of the clamp 16 into the fully clamped position.

A pair of markers 146, 148 are provided at the top of the outlet nipple 22. An orientation projection 150 is provided at a suitable location on the outer surface of the clamp 16 for visual confirmation by an observer on the derrick floor that the clamp 16 has been fully rotated such that the orientation projection 150 is aligned between the markers 146 and 148. If desired, a visual marker 152 (FIG. 4) may similarly be provided on the outer surface of the outer body 24 to provide a visual indication that the marker 152 is aligned between the markers 146 and 148, thereby indicating proper orientation of the upper body assembly 12 as it is lowered into the rotatable clamp 16 with the clamp 16 in the unclamped position. Clamp eyelets 154 are secured to the clamp 16 to facilitate both the lowering and raising of the clamp 16 and spool 14.

A plurality of circumferentially spaced apart segments 137 are integral with and extend radially inwardly from the upper inner surface of the clamp 16 (FIGS. 1 and 7). Upon full rotation of the clamp 16 to the clamped position, the radially inwardly extending segments 137 are disposed directly above the radially outwardly extending segments 134 on the outer body 24 of the upper body assembly 12 (FIG. 1). The lower surface of each clamp segment 137 is spaced above the top surface of the spool 14 to provide clearance for the upper body segments 134 only. During rotation of the clamp 16 from the unclamped position toward the clamped position, the lower surface of each clamp segment 137 scrapes along the top surface of its corresponding segment 134 thereby scraping away any accumulated mud or debris. This enhances the reliability of the clamping operation and reduces maintenance requirements.

The clamp 16 includes an upper clamp section 156 and a lower clamp section 158. The upper and lower clamp sections 156, 158 are secured together by a plurality of circumferentially spaced clamp bolt means 160. The lower clamp section 158 is rotatable within an annular groove 162 formed at the upper outer surface of the spool 14 (FIG. 1). The lower clamp section 158 includes a ring gear 164 formed on an arcuate section thereof. The ring gear 164 is driven by a pinion gear 166 which is keyed onto the shaft 168 of the hydraulic motor 20. An override extension 170 is secured to the upper end of the pinion gear 166 and is provided with a plurality of wrench flats for manually rotating the pinion gear 166 in the event of hydraulic motor failure. A guard cover 172 is provided over the pinion gear 166 and the ring gear 164. The hydraulic motor 20 is mounted on a motor mounting bracket 174 which is bolted to a boss 176 on the outer surface of the spool 14 via bolts 178.

Figure 5:
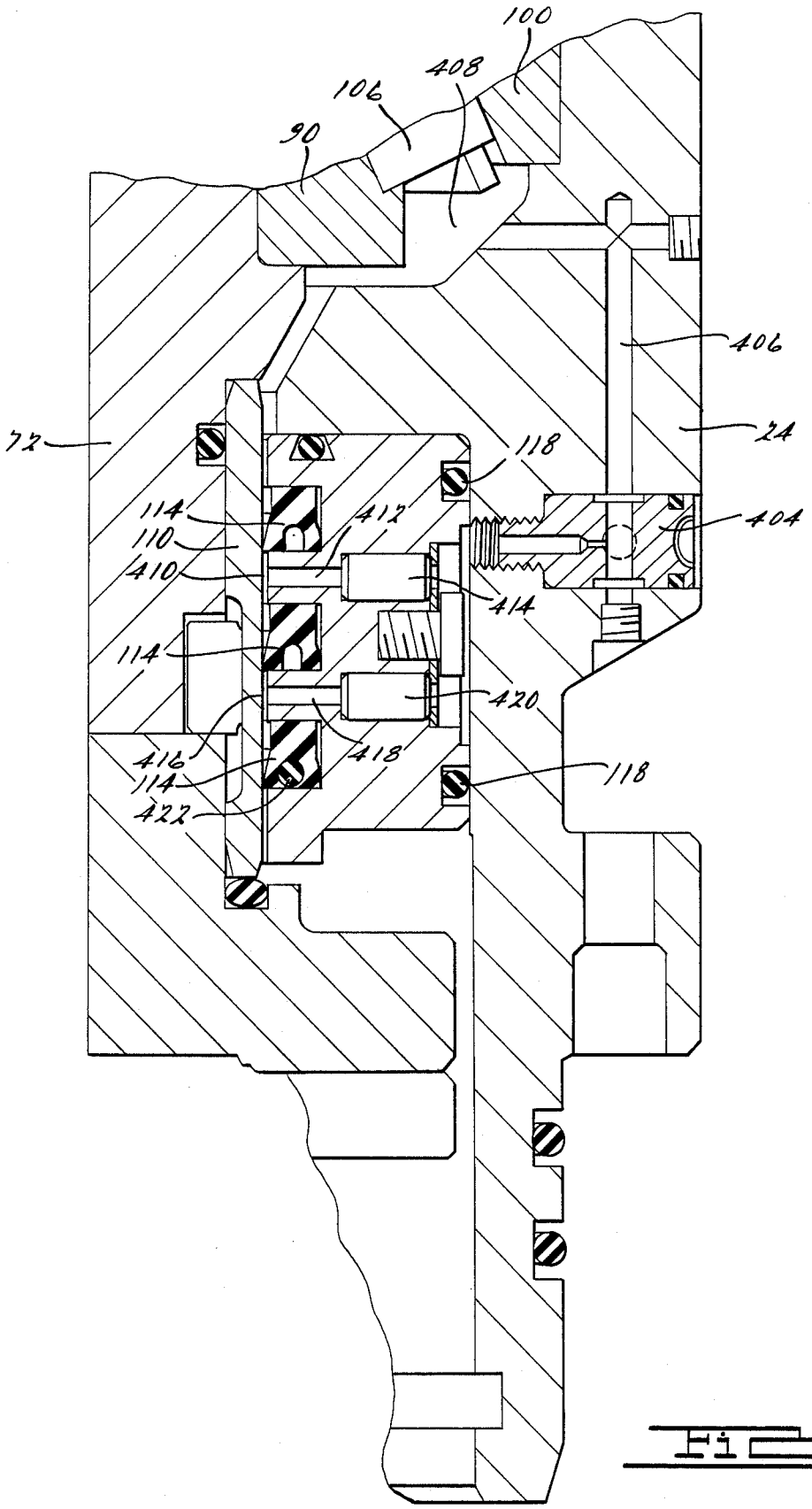
FIG. 5 is an enlarged fragmentary view of a portion of the lower body of FIG. 1 illustrating lubrication passageways.

Referring now to FIG. 5, lubrication is provided via a lubrication plug 404 in the outer body 24. A lube oil transfer passage 406 provides lubrication oil from the lubrication plug 404 to an annular cavity 408 about the lower portion of the bearing assembly 70. Lubrication oil is also provided to an annular cavity 410 between the uppermost and intermediate seals 114 from the passageway 412. A check valve 414 is provided at the outermost part of passage 412 to insure lubrication oil flow in the proper direction. Similarly, lubrication oil is provided to annular cavity 416 via passageway 418 and check valve 420. The check valves 414 and 420 operate to balance pressures about the lip seals 114. For additional structural integrity, an O-ring 422 is provided in a downwardly facing recess of the lowermost lip seal 114.

Figure 8:
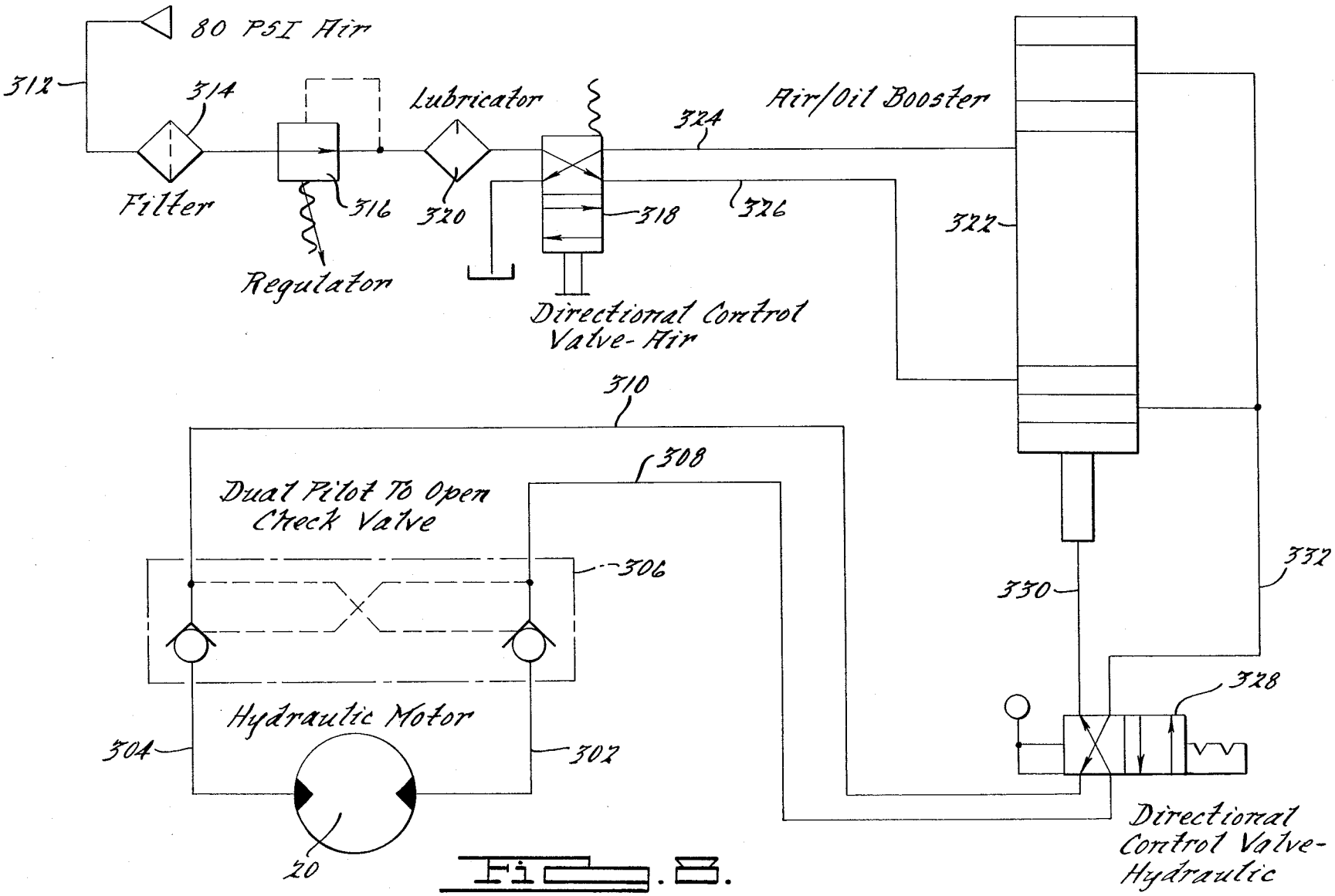
FIG. 8 is a schematic diagram showing the hydraulic circuit of the hydraulic motor of the drilling head.

Referring now to FIG. 8, a hydraulic control circuit is shown for operating hydraulic motor 20. Hydraulic fluid is supplied to motor 20 via hydraulic lines 302 and 304 coupled at their opposite ends to a hydraulic lock manifold 306. Hydraulic fluid is supplied to the hydraulic lock manifold 306 via lines 308 and 310. 80 pounds psi air is input to the circuit via line 312 to the input of an air filter 314. Filtered air is provided from the output of filter 314 to the input of an air regulator 316 having an output in turn coupled to one of two inputs of a directional air control valve 318 via lubricator 320. The output of the directional air control valve 318 is provided to an air/oil booster 322 via lines 324 and 326. The hydraulic output of the air/oil booster 322 is fed to a hydraulic directional control valve 328 via lines 330 and 332. The output of the hydraulic directional control valve 328 is supplied via lines 308 and 310 to the hydraulic lock manifold 306 which includes dual pilot to open check valves. With this air/hydraulic circuit the hydraulic motor 20 can be powered to rotate the clamp 16 in either a clamp engaging or a clamp releasing direction.

We claim:

1. A drilling head comprising:

a tubular spool;

a clamp rotatably mounted on said tubular spool, said clamp provided with first bayonet coupling means and adapted for rotation between a clamped position and an unclamped position;

an upper body assembly including an outer body, a rotatable kelly bushing adapted to receive a kelly drive member, drive means matable with said kelly bushing for rotation therewith, said drive means adapted for rotation within said outer body, a bearing assembly disposed between said drive means and said outer body, and an elastomeric stripper adapted for sealing engagement with said kelly drive member;

said outer body provided with second bayonet coupling means complementary with said first bayonet coupling means, said first and second bayonet coupling means adapted for lowering said upper body assembly through said clamp onto said tubular spool while said clamp is in said unclamped position; and means on said spool for rotating said clamp from said unclamped position to said clamped position to secure said upper body assembly to said tubular spool.

2. The drilling head of claim 1 wherein said first bayonet coupling means comprises a plurality of circumferentially spaced apart clamp segments fixedly provided on said clamp and extending radially inward, and said second bayonet coupling means comprises a plurality of circumferentially spaced apart segments fixedly provided on said outer body and extending radially outward.

3. The drilling head of claim 2 wherein said plurality of clamp segments and said plurality of body segments are substantially complemntary in configuration.

4. The drilling head of claim 3 wherein said plurality of clamp segments are disposed at an upper inner surface of said clamp and said plurality of body segments are disposed at a lower portion of said outer body.

5. The drilling head of claim 4 wherein said plurality of clamp segments and said body segments are arranged to scrape off debris accumulated about the clamp upon rotation of said clamp from the unclamped to clamped position.

6. The drilling head of claim 1 wherein said means for rotating comprises a hydraulic motor having an output shaft and gear means.

7. The drilling head of claim 6 wherein said gear means comprises a ring gear provided on an arcuate portion of the outer surface of said clamp and a pinion gear adapted for rotation with the output shaft of said hydraulic motor and engaging said ring gear.

8. The drilling head of claim 7 wherein said gear means further comprises an override extension attached to said pinion gear, said override extension provided with a plurality of wrench flats for receiving a wrench to manually rotate the pinion gear in the event of failure of the hydraulic motor.

9. The drilling head of claim 8 further comprising a hydraulic control circuit coupled to said hydraulic motor for remote control operation of the said hydraulic motor in a selected clamp engaging or clamp releasing direction.

10. The drilling head of claim 9 wherein said hydraulic control circuit comprises:

input means for connecting the control circuit to a source of pressurized air;

a directional air control valve connected to said input means;

a directional hydraulic control valve;

an accumulator having an input connected to said directional air control valve and an output connected to said directional hydraulic control valve;

a dual pilot to open check valve having input means connected to said directional hydraulic control valve and output means connected to said hydraulic motor.

11. A drilling head comprising:

a tubular spool having a top opening, a bottom opening, and a side opening;

a clamp rotatably secured about the tubular spool at its top opening, said clamp provided with a plurality of circumferentially spaced apart clamp segments extending radially inward and a plurality of openings with the clamp segments disposed above said top opening of said spool;

an upper body assembly including an outer body, a rotatable kelly bushing adapted to receive a kelly drive member, a drive bushing rotatable within said outer body, said drive bushing adapted for rotation with said rotatable kelly bushing, a drive ring secured to said drive bushing and adapted for rotation therewith, an elastomeric stripper secured to said drive ring and adapted for sealing engagement with said kelly drive member;

said outer body provided with a plurality of circumferentially spaced apart outer body segments extending radially outward and having a configuration substantially complementary with said plurality of openings formed in said clamp to facilitate lowering said outer body through said clamp onto said spool with said clamp disposed in an unclamped position;

clamp support means provided on said tubular spool for rotatably supporting said clamp at said top opening while said clamp is in said unclamped position; and means or said spool for rotating said clamp from said unclamped position to a clamped position to secure said upper body assembly lowered onto said spool, said outer body segments disposed beneath said clamp segments upon rotation of said clamp to said clamped position.

12. The drilling head of claim 11 wherein said drive bushing includes:

an inner drive bushing member;

an outer drive bushing housing; and an elastomeric shock absorber sandwiched between the outer drive bushing housing and said inner drive bushing member, said shock absorber generally corrugated in cross-sectional shape.

13. The drilling head of claim 12 wherein said elastomeric shock absorber is mated with and bonded to the outer surface of said inner drive bushing member.

14. A drilling head comprising:

a tubular spool;

an upper body assembly including an outer body, a rotatable kelly bushing adapted to receive a kelly drive member, rotatable drive means coupled with said kelly bushing for rotation therewith, said drive means adapted for rotation within said outer body, a bearing assembly disposed between said outer body and said rotatable drive means, first lubrication coupler means disposed on the outer surface of said outer body, said outer body provided with lubrication passage means for providing lubrication both to said bearing assembly and between said rotatable drive means and the inside of said outer body, said lubrication passage means in communication with said first lubrication coupler means;

clamp means movable between an unclamped position for providing clearance to lower said upper body assembly onto said tubular spool and a clamped position for securing said upper body assembly to said spool, said clamp means provided with second lubrication coupler means;

said second lubrication coupler means adapted to receive lubrication from a lubrication source, said second lubrication coupler means mated with said first lubrication coupler means while said clamp means is in said clamped position for providing lubrication from said lubrication source to said lubrication passage means.

15. The drilling head of claim 14 further comprising means for adjustably mounting said second lubrication coupler means on said clamp means to align said second lubrication coupler means with said first lubrication coupler means disposed on the outer surface of said outer body.

16. The drilling head of claim 14 further comprising shock absorber means connected with said second lubrication coupler means to absorb shock while said first and second lubrication coupler means mate upon rotation of said clamp means toward said clamped position.

17. The drilling head of claim 15 wherein said means for adjustably mounting said second lubrication coupler means comprises a threaded adjusting rod.

18. The drilling head of claim 17 further comprising a cushion ring disposed about said threaded adjusting rod to absorb shock while said first and second lubrication coupler means mate upon rotation of said clamp means toward said clamped position.

19. The drilling head of claim 14 wherein said drive means includes a wear ring and said drilling head further comprises a seal holder assembly with a plurality of vertically aligned and spaced apart lip seals disposed between the inside of said outer body and in sealing engagement with said wear ring, lubrication passage means formed in said seal holder assembly and in communication with said outer body lubrication passage means for providing lubrication to said wear ring between said seals, and check valve means disposed in said seal holder assembly passage means for balancing pressures about said lip seals.

20. The drilling head of claim 19 wherein said plurality of vertically aligned and spaced apart lip seals includes at least three lip seals, and sealed holder assembly passage means includes two separate passageways, and said check valve means includes two check valves, one of said check valves contained in each of said separate passageways.

21. A drilling head comprising:

a tubular spool;

an upper body assembly including an outer body, a rotatable kelly bushing adapted to receive a kelly drive member, a rotatable drive bushing assembly adapted for rotation with said kelly bushing and within said outer body, a bearing assembly disposed between said rotatable drive bushing assembly and said outer body, and an elastomeric stripper adapted for sealing engagement with said kelly drive member;

means for releasably clamping said upper body assembly onto said tubular spool; and said rotatable drive bushing assembly including an inner drive bushing member, an outer drive bushing housing, a cushion member formed in a generally corrugated cross-sectional shape, said cushion member sandwiched between said inner drive bushing member and said outer drive bushing housing, an inner surface of said inner drive member adapted for engagement with said kelly drive member, a radially outer surface of said inner drive member complementary in configuration to the generally corrugated cross-sectional shape of said cushion member, a radially inner surface of said outer drive bushing housing provided with a configuration complementary to said generally corrugated cross-sectional shape of said cushion member.

22. A drilling head comprising:

a tubular spool;

an upper body assembly including an outer body, a rotatable kelly bushing adapted to receive a kelly drive member, rotatable drive means coupled with said rotatable kelly bushing for rotation therewith, a bearing assembly disposed between said rotatable drive means, and an elastomeric stripper adapted for sealing engagement with said kelly drive member;

clamp means for releasably clamping said upper body assembly onto said tubular spool;

said rotatable kelly bushing formed by separable first and second members complementary in configuration, said first and second members each provided with an upper arm portion at one end and a lower arm portion at an opposite end, said first and second members interfitted with the upper arm of said first member disposed above the lower arm of said second member and the upper arm of said second member disposed above the lower arm of said first member, said upper arm of said first member and said lower arm of said second member each provided with vertically aligned fastener receiving means, said upper arm of said second member and said lower arm of said first member each provided with vertically aligned fastener receiving means, first fastener means extending downwardly through said fastener receiving means of said first member upper arm into said second member lower arm, and second fastener means extending downwardly through said second member upper arm into the fastener receiving means of said first member lower arm.

23. A drilling head comprising:

a tubular spool;

an upper body assembly including an outer body provided with first bayonet coupling means, a rotatable kelly bushing adapted to receive a kelly drive member, drive means matable with said kelly bushing for rotation therewith, said drive means adapted for rotation within said outer body, a bearing assembly disposed between said drive means and said outer body, and an elastomeric stripper adapted for sealing engagement with said kelly drive member;

a clamp rotatably mounted on said tubular spool, said clamp provided with second bayonet coupling means and rotatable between an unclamped position for providing clearance between said first and second bayonet coupling means to lower said upper body assembly onto said tubular spool and a clamped position for securing said upper body assembly to said spool;

means provided on said tubular spool for receiving and rotatably supporting said clamp on said tubular spool while said clamp is disposed in said unclamped position; and means on said spool for rotating said clamp from said unclamped position to said clamped position to secure said upper body assembly to said tubular spool.

24. The drilling head of claim 23 further comprising first lubrication coupler means disposed on said outer body;

said outer body provided with lubrication passage means for providing lubrication to said bearing assembly and said drive means, said lubrication passage means in communication with said first lubrication coupler means;

second lubrication coupler means adapted to receive lubrication from a lubrication source, said second lubrication coupler means in communication with said first lubrication coupler means upon rotation of said clamp to said clamped position for providing lubrication from said lubrication source to said lubrication passage means.

25. The drilling head of claim 24 further comprising first indicator means associated with said upper body assembly for indicating proper orientation of said upper body relative to said clamp while said upper body assembly is lowered through said clamp.

26. The drilling head of claim 25 further comprising second indicator means associated with said clamp for indicating the rotation of said clamp to said clamped position.

27. The drilling head of claim 23 wherein said means for rotating comprises hydraulic motor means coupled to said clamp.

28. The drilling head of claim 27 further comprising a hydraulic control circuit adapted for remote control operation of said hydraulic motor means.

29. The drilling head of claim 28 wherein said hydraulic control circuit comprises:

input means for connecting the control circuit to a source of pressurized air;

a directional air control valve connected to said input means;

a directional hydraulic control valve;

an accumulator having an input connected to said directional air control valve and an output connected to said directional hydraulic control valve;

a dual pilot to open check valve having input means connected to said directional hydraulic control valve and output means connected to said hydraulic motor means.

30. The drilling head of claim 23 wherein said drive means includes:

a drive bushing inner member;

a drive bushing outer housing;

an elastomeric shock absorbing member generally corrugated in cross sectional shape, bonded to an outer surface of said drive bushing inner member and said elastomeric shock absorbing member sandwiched between said drive bushing inner member and said drive bushing outer housing.

* * * * *